US011081823B2

(12) United States Patent
Zhang et al.

(10) Patent No.: US 11,081,823 B2
(45) Date of Patent: Aug. 3, 2021

(54) CONDUCTIVE TERMINAL AND ELECTRICAL CONNECTOR

(71) Applicant: Tyco Electronics (Shanghai) Co. Ltd., Shanghai (CN)

(72) Inventors: Zhicheng Zhang, Shanghai (CN); Jiayong He, Shanghai (CN); YuQiang Zhao, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/683,944

(22) Filed: Nov. 14, 2019

(65) Prior Publication Data

US 2020/0153141 A1 May 14, 2020

(30) Foreign Application Priority Data

Nov. 14, 2018 (CN) ..... 201811354636.0

(51) Int. Cl.
*H01R 13/11* (2006.01)
*H01R 24/60* (2011.01)

(52) U.S. Cl.
CPC ..... *H01R 13/11* (2013.01); *H01R 24/60* (2013.01)

(58) Field of Classification Search
CPC ..... H01R 13/18; H01R 13/187; H01R 13/11
See application file for complete search history.

(56) References Cited

U.S. PATENT DOCUMENTS 5,649,837 A * 7/1997 Arnold ..... H01R 13/6315 439/247
8,366,497 B2 * 2/2013 Glick ..... H01R 13/187 439/839
8,992,270 B2 * 3/2015 Glick ..... H01R 13/187 439/839
10,847,914 B2 * 11/2020 Kobayashi ..... H01R 13/11
2019/0089081 A1 * 3/2019 Zhang ..... H01R 13/24

FOREIGN PATENT DOCUMENTS

CN 207442024 U 6/2018
CN 109038003 A 12/2018
CN 110391528 A 10/2019

OTHER PUBLICATIONS

Abstract of CN109038003, dated Dec. 18, 2018, 1 page.
Abstract of CN110391528, dated Oct. 29, 2019, 1 page.
Abstract of CN207442024, dated Jun. 1, 2018, 1 page.

* cited by examiner

*Primary Examiner* — Ross N Gushi
(74) *Attorney, Agent, or Firm* — Barley Snyder

(57) ABSTRACT

A conductive terminal includes a first terminal and a second terminal stacked on the first terminal. The first terminal has a plurality of first contact portions at an end of the first terminal. A gap is formed between two adjacent first contact portions. The second terminal has a second contact portion at an end of the second terminal. At least a part of the second contact portion extends through the gap of the first terminal.

19 Claims, 6 Drawing Sheets

CONDUCTIVE TERMINAL AND ELECTRICAL CONNECTOR

CROSS-REFERENCE TO RELATED APPLICATION

This application claims the benefit of the filing date under 35 U.S.C. § 119(a)-(d) of Chinese Patent Application No. 201811354636.0, filed on Nov. 14, 2018.

FIELD OF THE INVENTION

The present invention relates to an electrical connector and, more particularly, to a conductive terminal of an electrical connector.

BACKGROUND

Electrical connectors typically include an insulated body and conductive terminals, such as power terminals, held in the insulated body. A conductive terminal may have a double-layer structure, which generally includes an inner layer terminal at an inner layer thereof and an outer layer terminal at an outer layer thereof. The inner layer terminal is typically made of copper and the outer layer terminal is typically made of stainless steel. The outer layer terminal is clamped on the inner layer terminal, so that the clamping force of the whole conductive terminal is improved, and the reliability of electrical contact is ensured.

The outer layer terminal made of stainless steel has a length shorter than that of the inner layer terminal made of copper and does not make electrical contact with a mating member, such as a bus bar. Only the inner layer terminal makes electrical contact with the mating member, and consequently, the current carrying capacity of the conductive terminal is limited. However, as application currents become larger, the conductive terminals of the power connector are required to be able to carry larger currents. Therefore, the existing conductive terminal with the double-layer structure cannot meet the above mentioned requirements.

SUMMARY

A conductive terminal includes a first terminal and a second terminal stacked on the first terminal. The first terminal has a plurality of first contact portions at an end of the first terminal. A gap is formed between two adjacent first contact portions. The second terminal has a second contact portion at an end of the second terminal. At least a part of the second contact portion extends through the gap of the first terminal.

BRIEF DESCRIPTION OF THE DRAWINGS

The invention will now be described by way of example with reference to the accompanying Figures, of which.

DETAILED DESCRIPTION OF THE EMBODIMENT(S)

Figure 1A:
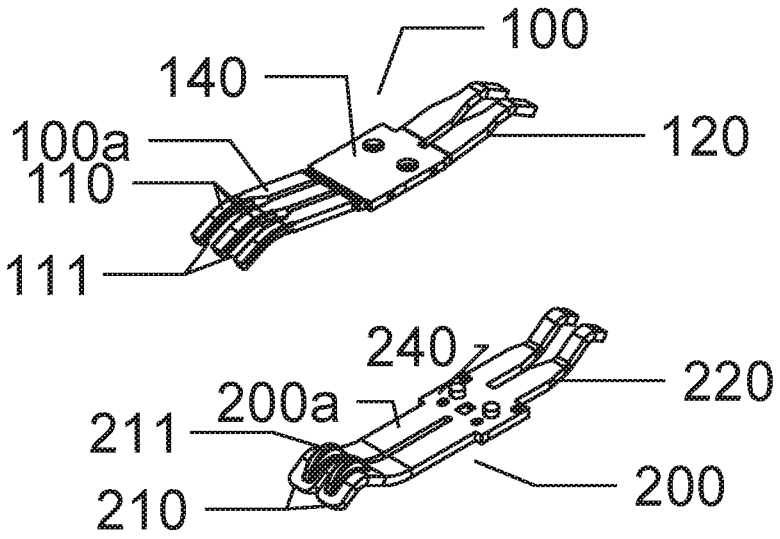
FIG. 1A is an exploded perspective view of a conductive terminal according to an embodiment.

Exemplary embodiments of the present disclosure will be described hereinafter in detail with reference to the attached drawings, wherein like reference numerals refer to like elements. It should be understood that the description to the embodiments of the present disclosure in conjunction with the attached drawings is to convey a general concept of the present disclosure, and is not intended to limit the present disclosure to the described exemplary embodiments.

Furthermore, in the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 1B:
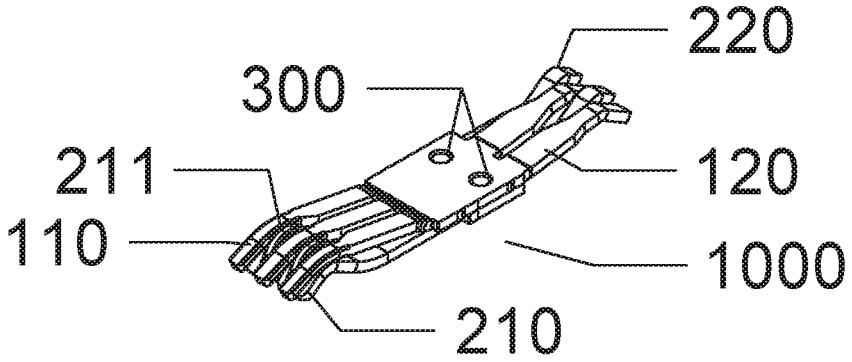
FIG. 1B is a perspective view of the conductive terminal in an assembled state.

A conductive terminal 1000 according to an embodiment, as shown in FIGS. 1A and 1B, includes a first terminal 100 and a second terminal 200 stacked on each other. The first terminal 100 has three first contact portions 110 at one end thereof, the second terminal 200 has two second contact portions 210 at one end thereof. A gap 111 is formed between two adjacent first contact portions 110, a protrusion 211 is formed on each second contact portion 210, and the protrusion 211 is adapted to pass through the first terminal 100 via the gap 111, so that the first contact portion 110 and the protrusion 211 are brought into electrical contact with a mating member.

Although the first terminal 100 in the embodiment of FIGS. 1A and 1B has three first contact portions 110, the number of the first contact portions 110 may not be limited to three as long as there are at least two. Although the second terminal 200 in the embodiment of FIGS. 1A and 1B has two second contact portions 210, it is known to those skilled in the art that the number of the second contact portions 210 may not be limited to two as long as there is at least one.

As shown in FIG. 1B, the protrusion 211 has a height greater than that of the first contact portion 110, so that when the second terminal 200 is attached to the first terminal 100, the protrusion 211 protrudes beyond an inner surface, an upper surface in FIGS. 1A and 1B, which is to be in contact with the mating member, of the first terminal 100 via the gap 111. In this case, during the mating process with the mating member, the mating member is brought into contact with the protrusion 211 of the second terminal 200 first, and then is brought into contact with the first contact portion 110 of the first terminal 100.

In another embodiment, the second terminal 200 and the first terminal 100 are spaced apart from each other such that the protrusion 211 of the second terminal 200 is flush with the inner surface of the first terminal 100. In this case, during the mating process with the mating member, the mating member is simultaneously brought into contact with the first contact portion 110 of the first terminal 100 and with the protrusion 211 of the second terminal 200.

In another embodiment, the second terminal 200 and the first terminal 100 are spaced apart from each other such that the protrusion 211 of the second terminal 200 is lower than the inner surface of the first terminal 100. In this case, during the mating process with the mating member, the mating member is brought into contact with the first contact portion 110 of the first terminal 100 first and pushes the first terminal 100 to elastically move toward the second terminal 200 at the same time, and in turn is brought into contact with the protrusion 211 of the second terminal 200.

Figure 2A:
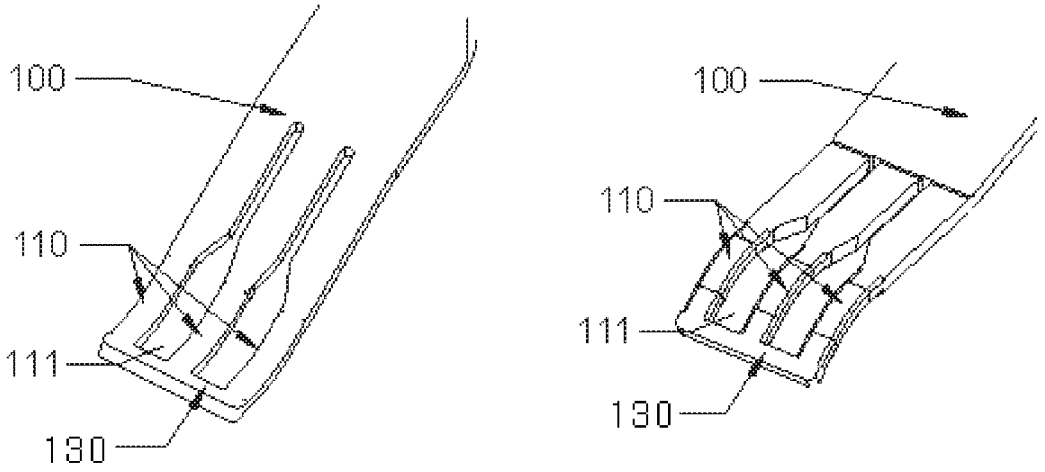
FIG. 2A is a top and a bottom perspective view of a first contact portion of a first terminal of the conductive terminal according to an embodiment.
Figure 2B:
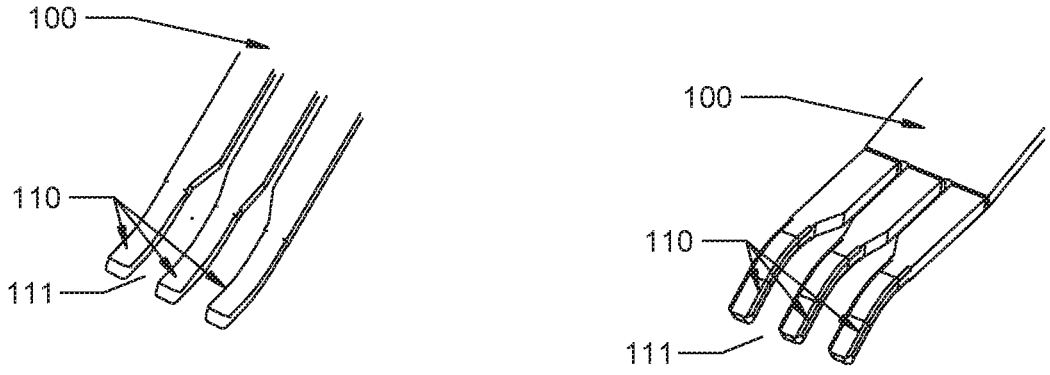
FIG. 2B is a top and a bottom perspective view of a first contact portion of a first terminal of the conductive terminal according to another embodiment.
Figure 2C:
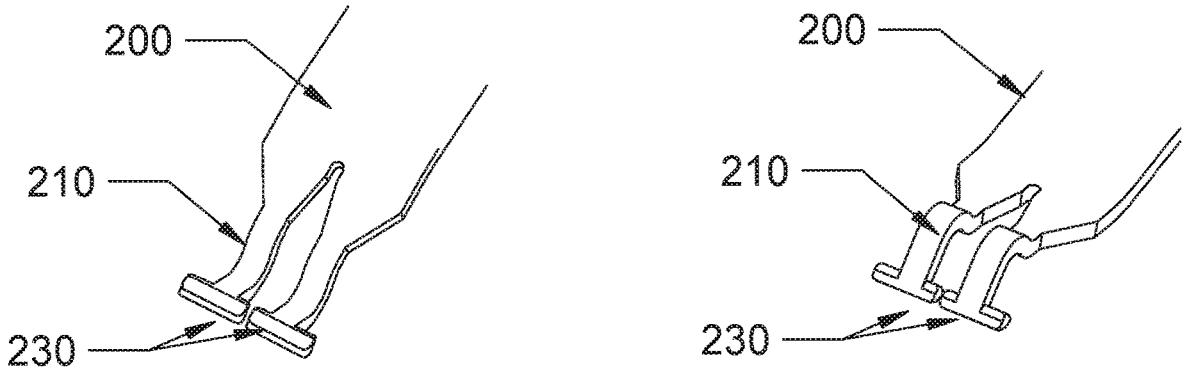
FIG. 2C is a top and a bottom perspective view of a second contact portion of a second terminal of the conductive terminal according to an embodiment.
Figure 2D:
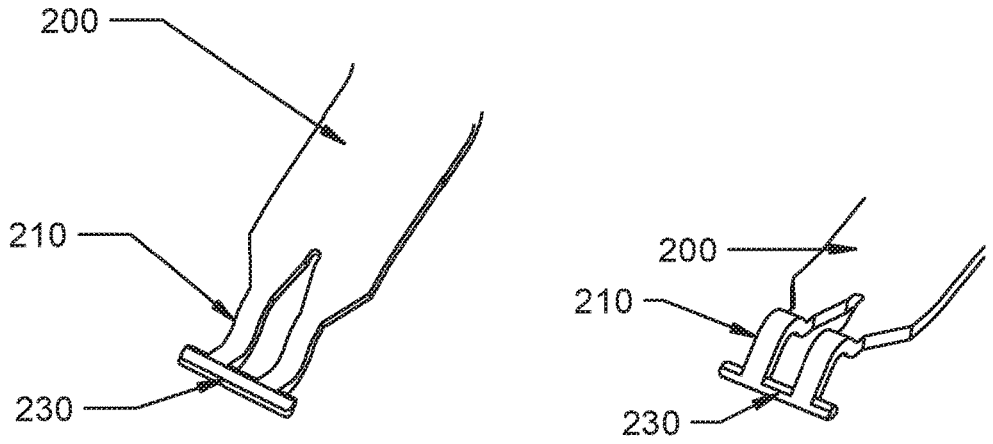
FIG. 2D is a top and a bottom perspective view of a second contact portion of a second terminal of the conductive terminal according to another embodiment.

FIGS. 2A and 2B illustrate various embodiments of the first contact portion 110 of the first terminal 100, and FIGS. 2C and 2D illustrate various embodiments of the second contact portion 210 of the second terminal 200. FIGS. 3A-3D illustrate the assembled state of combinations of the first contact portion 110 of FIGS. 2A and 2B with the second contact portion 210 of FIGS. 2C and 2D.

Figure 3A:
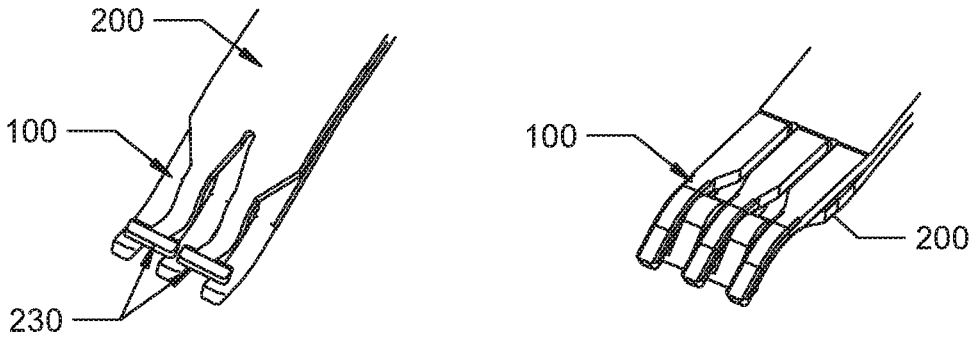
FIG. 3A is a top and a bottom perspective view of the first contact portion of FIG. 2B and the second contact portion of FIG. 2C in an assembled state.
Figure 3B:
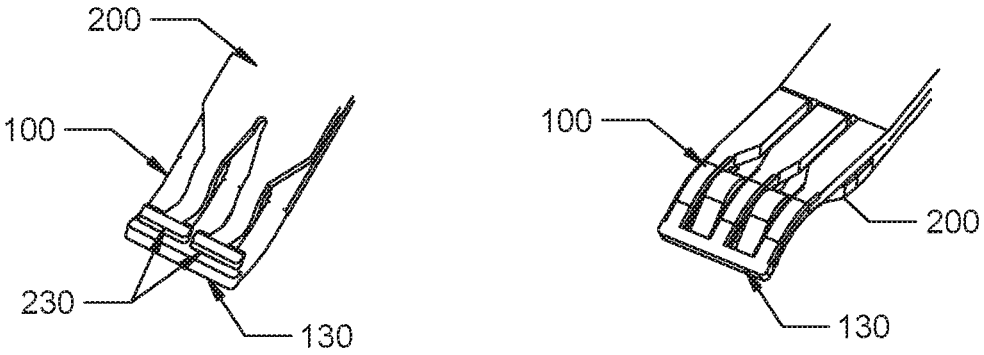
FIG. 3B is a top and a bottom perspective view of the first contact portion of FIG. 2A and the second contact portion of FIG. 2C in an assembled state.
Figure 3C:
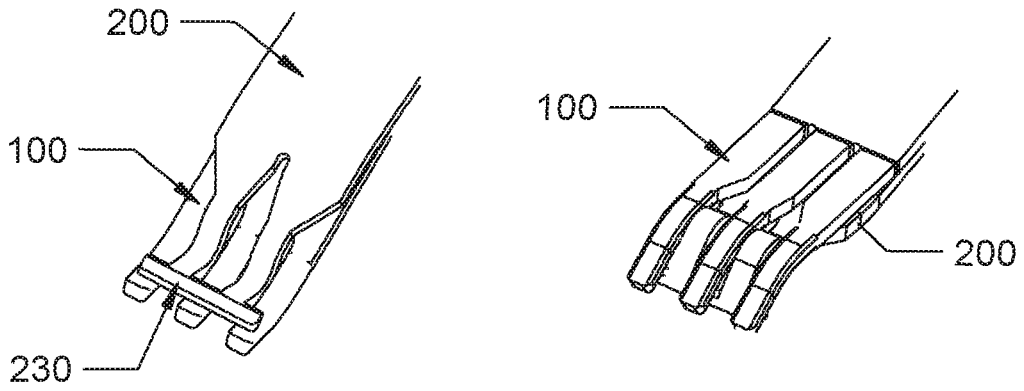
FIG. 3C is a top and a bottom perspective view of the first contact portion of FIG. 2B and the second contact portion of FIG. 2D in an assembled state.
Figure 3D:
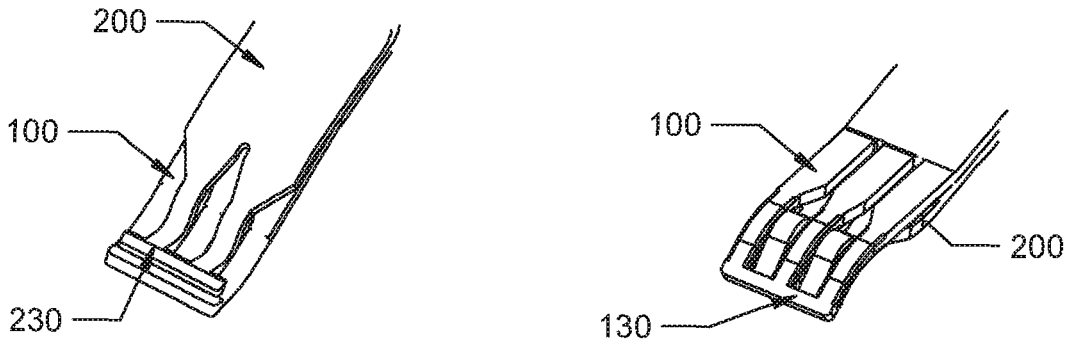
FIG. 3D is a top and a bottom perspective view of the first contact portion of FIG. 2A and the second contact portion of FIG. 2D in an assembled state.

As shown in the embodiment of FIGS. 2A, 3B and 3D, the ends of two adjacent first contact portions 110 are connected by a connection portion 130, and the connection portion 130 is adapted to abut against an end of the second contact portion 210, so as to prevent the end of the second contact portion 210 from passing through the first terminal 100 via the gap 111.

As shown in the embodiment of FIGS. 2C and 3A, the second contact portion 210 is formed with a second stopper 230 at an end. A width of the second stopper 230 is set to be larger than the gap 111 and adapted to abut against the first contact portion 110 on both sides of the gap 111, so as to prevent the end of the second contact portion 210 from passing through the first terminal 100 via the gap 111.

As shown in the embodiment of FIGS. 2D, 3C and 3D, the second terminal 200 has two second contact portions 210 at an end. In this embodiment, the second stoppers 230 of the two second contact portions 210 are connected to form an integral body, preventing the ends of the second contact portions 210 from passing through the first terminal 100 via the gap 111.

The first terminal 100, as shown in FIG. 1A, includes a first fixing portion 140 adapted to be fixed in an insulated body and a row of first elastic cantilevers 100*a* located at a first side of the first fixing portion 140. Each first elastic cantilever 100*a* has one first contact portion 110 at a free end, and the gap 111 is formed between two adjacent first contact portions 110. The second terminal 200 includes a second fixing portion 240 adapted to be fixed in the insulated body and a row of second elastic cantilevers 200*a* located at a first side of the second fixing portion 240. Each second elastic cantilever 200*a* has one second contact portion 210 at a free end.

The first terminal 100, as shown in FIGS. 1A and 1B, includes a row of first connection pins 120 located at a second side of the first fixing portion 140 and adapted to be electrically connected to a circuit board. The second terminal 200 further includes a row of second connection pins 220 located at a second side of the second fixing portion 240 and adapted to be electrically connected to a circuit board. When the first terminal 100 and the second terminal 200 are stacked on each other, the row of first connection pins 120 and the row of second connection pins 220 are arranged in a staggered manner.

As shown in FIG. 1B, the conductive terminal 1000 includes an connection member 300 connecting the first fixing portion 140 of the first terminal 100 and the second fixing portion 240 of the second terminal 200 together, so that the first terminal 100 and the second terminal 200 are assembled as an integral component.

In an embodiment, the first terminal 100 is a single member made of a single piece of metal plate, and the second terminal 200 is also a single member made of a single piece of metal plate.

Figure 4A:
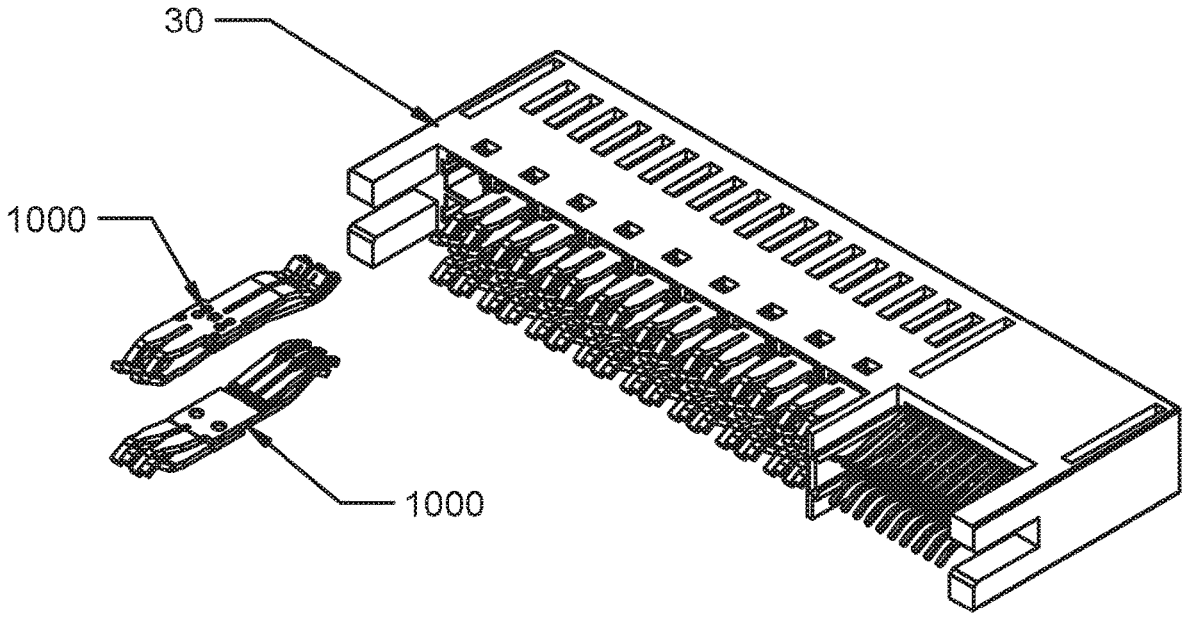
FIG. 4A is a rear perspective view of an electrical connector according to an embodiment.
Figure 4B:
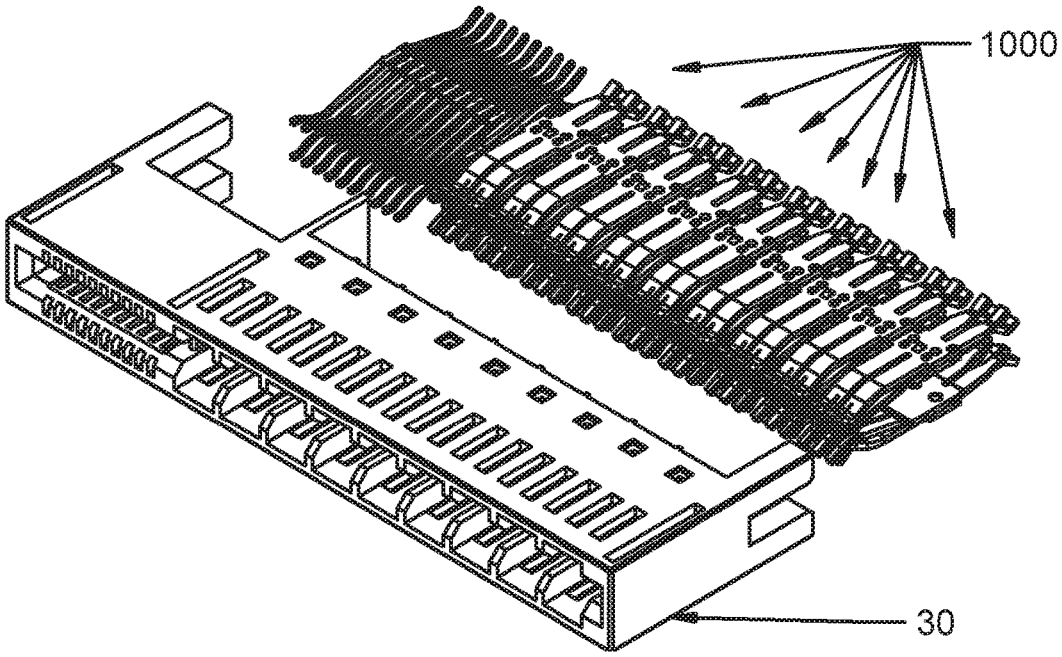
FIG. 4B is a front perspective view of the electrical connector of FIG. 4A.

In an embodiment shown in FIGS. 4A and 4B, an electrical connector includes a plurality of the conductive terminals 1000 and an insulated body 30 in which the conductive terminals 1000 are held.

The first terminal 100 and the second terminal 200 may be simultaneously bought into electrical contact with the mating member, thereby improving the current carrying capacity of the conductive terminal 1000. Further, the first terminal 100 and the second terminal 200 are arranged in a staggered manner such that it is feasible to arrange as many effective contacts as possible in a given space, and the conductive terminal 1000 is capable of carrying larger current.

It should be appreciated for those skilled in this art that the above embodiments are all exemplary embodiments, and many modifications may be made to the above embodiments by those skilled in this art, and various features described in different embodiments may be freely combined with each other without conflicting in configuration or principle.

Although several embodiments of the general concept of the present disclosure have been shown and described, it would be appreciated by those skilled in the art that various changes or modifications may be made in these embodiments without departing from the principles and spirit of the disclosure, the scope of which is defined in the claims and their equivalents.

What is claimed is:

1. A conductive terminal, comprising:

a first terminal having a plurality of first contact portions at an end of the first terminal for establishing direct electrical contact with a mating member, a gap is formed between two adjacent first contact portions; and a second terminal stacked on the first terminal, the second terminal having a second contact portion at an end of the second terminal, at least a part of the second contact portion extends through the gap of the first terminal for establishing direct electrical contact with the mating member, wherein a pair of ends of each of a pair of adjacent first contact portions are connected by a connection portion, the connection portion abuts against an end of the second contact portion on a side of the second contact portion contacting the mating member.

2. The conductive terminal of claim 1, wherein the second contact portion has a protrusion extending through the gap.

3. The conductive terminal of claim 2, wherein the protrusion has a height greater than a height of the first contact portion, the protrusion protrudes through the gap and beyond an upper surface of the first terminal.

4. The conductive terminal of claim 3, wherein, during mating with the mating member, the mating member contacts the protrusion of the second terminal before contacting the first contact portion.

5. The conductive terminal of claim 2, wherein the second terminal and the first terminal are spaced apart from each other and the protrusion is flush with an upper surface of the first terminal.

6. The conductive terminal of claim 5, wherein, during mating with the mating member, the mating member simultaneously contacts the protrusion of the second terminal and the first contact portion.

7. The conductive terminal of claim 2, wherein the second terminal and the first terminal are spaced apart from each other and the protrusion is below an upper surface of the first terminal.

8. The conductive terminal of claim 7, wherein, during mating with the mating member, the mating member contacts the first contact portion before contacting the protrusion of the second terminal.

9. The conductive terminal of claim 8, wherein the mating member elastically pushes the first terminal toward the second terminal.

10. The conductive terminal of claim 1, wherein the second contact portion has a second stopper at an end of the second contact portion, a width of the second stopper is larger than the gap and the second stopper abuts against the first contact portion on a pair of opposite sides of the gap, the second stopper arranged distally from an upper contact surface of the second contact portion contacting the mating member.

11. The conductive terminal of claim 10, wherein the second terminal has a pair of second contact portions at the end of the second terminal, the second stoppers of the second contact portions are connected together to form an integral body.

12. The conductive terminal of claim 1, wherein the first terminal has a first fixing portion fixed in an insulated body and a row of first elastic cantilevers at a first side of the first fixing portion, each first elastic cantilever has one first contact portion at a free end of the first elastic cantilever.

13. The conductive terminal of claim 12, wherein the second terminal has a second fixing portion fixed in the insulated body and a row of second elastic cantilevers at a first side of the second fixing portion, each second elastic cantilever has a second contact portion at a free end of the second elastic cantilever.

14. The conductive terminal of claim 13, wherein the first terminal has a row of first connection pins at a second side of the first fixing portion, the first connection pins electrically connected to a circuit board.

15. The conductive terminal of claim 14, wherein the second terminal has a row of second connection pins at a second side of the second fixing portion, the second connection pins electrically connected to the circuit board, the row of first connection pins and the row of second connection pins are arranged in a staggered manner.

16. The conductive terminal of claim 13, further comprising a connection member connecting the first fixing portion and the second fixing portion.

17. The conductive terminal of claim 1, wherein the first terminal and the second terminal are each a single member made of a single piece of sheet metal.

18. An electrical connector, comprising:

an insulated body; and a plurality of conductive terminals held in the insulated body, each of the conductive terminals includes:

a first terminal having a first fixing portion fixed in the insulated body and a row of first elastic cantilevers at a first side of the first fixing portion, each first elastic cantilever having one of a plurality of first contact portions at a free end thereof; and a second terminal stacked on the first terminal having a second fixing portion fixed in the insulated body and a row of second elastic cantilevers at a first side of the second fixing portion, each second elastic cantilever having a second contact portion at a free end thereof, a gap is formed between two adjacent first contact portions, at least a part of the second contact portion extends through the gap of the first terminal.

19. A conductive terminal, comprising:

a first terminal having a plurality of first contact portions at an end of the first terminal adapted to establish direct electrical contact with a mating member, a gap is formed between two adjacent first contact portions; and a second terminal stacked on the first terminal, the second terminal having a second contact portion at an end of the second terminal, the second contact portion having a protrusion extending through the gap of the first terminal in a direction toward an upper contact surface of the first contact portion for establishing direct electrical contact with the mating member, the second terminal and the first terminal are spaced apart from each other with the protrusion of the second contact portion flush with the upper contact surface of the first terminal.

* * * * *